US009480286B2

(12) United States Patent
Liu

(10) Patent No.: US 9,480,286 B2
(45) Date of Patent: Nov. 1, 2016

(54) ELECTRONIC CIGARETTE DEVICE AND ELECTRONIC CIGARETTE THEREOF

(71) Applicant: Qiuming Liu, Shenzhen (CN)

(72) Inventor: Qiuming Liu, Shenzhen (CN)

(73) Assignee: HUIZHOU KIMREE TECHNOLOGY CO., LTD., SHENZHEN BRANCH, Shenzhen, Guangdong Province (CN)

( * ) Notice: Subject to any disclaimer, the term of this patent is extended or adjusted under 35 U.S.C. 154(b) by 761 days.

(21) Appl. No.: 13/988,760

(22) PCT Filed: Jan. 16, 2013

(86) PCT No.: PCT/CN2013/070552
§ 371 (c)(1),
(2) Date: May 21, 2013

(87) PCT Pub. No.: WO2014/110740
PCT Pub. Date: Jul. 24, 2014

(65) Prior Publication Data

US 2014/0196716 A1 Jul. 17, 2014

(51) Int. Cl.
*A24F 47/00* (2006.01)

(52) U.S. Cl.
CPC ..... *A24F 47/008* (2013.01)

(58) Field of Classification Search
CPC .... A24F 47/00; A24F 47/002; A24F 47/008; A61M 11/00; A61M 15/06
USPC ..... 131/194, 273; 128/202.21
See application file for complete search history.

(56) References Cited

U.S. PATENT DOCUMENTS 6,125,853 A * 10/2000 Susa ..... A24F 47/008 131/194
2011/0265806 A1* 11/2011 Alarcon ..... A24F 47/00 131/273

* cited by examiner

*Primary Examiner* — Joseph S Del Sole
*Assistant Examiner* — Mohamed K Ahmed Ali
(74) *Attorney, Agent, or Firm* — Cheng-Ju Chiang

(57) ABSTRACT

The present invention discloses an electronic cigarette including connected first and second bodies. Opposing ends of the first and second stem bodies are respectively provided with matched first and second insertion members making the first and second stem bodies be stably connected with each other. Herein, a side wall of the first insertion member is provided circumferentially with a locking member of which a protrusion end is arc-shaped, while a side wall of the second insertion member is correspondingly provided with a locking groove engaged with the locking member such that the locking member is inserted therein. The locking member is provided on the first stem body and the corresponding locking groove is provided on the second stem body, thus realizing secure connection between the first and second stem bodies, making the structure simple, bringing out convenience in assembling and disassembling process and high stability.

15 Claims, 11 Drawing Sheets

ELECTRONIC CIGARETTE DEVICE AND ELECTRONIC CIGARETTE THEREOF

CROSS REFERENCE TO RELATED APPLICATIONS

The present application is a 35 U.S.C. §371 National Phase conversion of International (PCT) Patent Application No. PCT/CN2013/070552, filed on Jan. 16, 2013, the disclosure of which is incorporated by reference herein. The PCT International Patent Application was filed in Chinese.

FIELD OF THE INVENTION

The present invention relates to the technical field of electronic cigarette and cigar case and more particularly, relates to an electronic cigarette and electronic cigarette device of which a first stem body of the atomization device and a second stem body of the battery are connected with each other by a locking member and a locking groove.

BACKGROUND OF THE INVENTION

A may stem body of a conventional electronic cigarette is generally constructed of a first and stem body and a second stem both of which are connected with each other. An atomization device is disposed in the first stem body, while a battery is disposed in the second stem body. A connection portion of the first stem body is provided with an electrode component electrically connected to the atomization device, while a connection portion of the second the stem body is provided with an electrode component electrically connected to the positive and negative electrodes.

The connection portions of the first and second the stem bodies of a conventional detachable electronic cigarette are provided with are matched screws respectively for realizing screwing connection of the tow parts. Using screwing connection, repeat rotation of many times is required to realize secure connection between the first and second stem bodies, thus leading to trouble in assemble and disassembly and resulting in time consumption. At the same time, due to rotation for many times or rotation with undue force, thread will be stripped, hence resulting in unstable connection between the first and second stem bodies, and even resulting in bad contact between the atomization device and battery, and finally resulting in abnormal operation of the electronic cigarette.

The battery inside a conventional electronic cigarette is generally provided as a disposable battery and when electricity of the battery wears out, the battery is even the entire electronic cigarette will be discarded, thus resulting in serious waste and increasing cost of the smoker spending on smoking.

SUMMARY OF THE INVENTION

The technical problem to be resolved by the present invention is to provide an electronic cigarette which has simple connection construction, is easy to be assembled and disassembled, and has high reliable connection.

Another technical problem to be resolved by the present invention is to provide an electronic cigarette device having an electronic cigarette which has simple connection construction, is easy to be assembled and disassembled, and has high reliable connection.

To resolve about technical problems, the present invention discloses an electronic cigarette which includes connected first and second bodies. Opposing ends of the first and second stem bodies are respectively provided with matched first and second insertion members which make the first and second stem bodies be stably connected with each other. Herein, a side wall of the first insertion member is provided circumferentially with a locking member of which a protrusion end is arc-shaped, while a side wall of the second insertion member is correspondingly provided with a locking groove engaged with the locking member such that the locking member is inserted therein.

Furthermore, the locking member is a plurality of spherical bodies circumferentially and evenly arranged on the first insertion member. A locating hole is defined in the side wall of the first insertion member. The locating hole passes through the side wall of the first insertion member and its outer diameter is smaller than diameter of the locking member so as to receive the locking member therein and let one end of the locking member to be extended out.

Furthermore, one side of the locking member adjacent the locating hole is provided with a resilient pressing member for resiliently pressing the locking member inside the locating hole.

Preferably, a holding groove is defined in the first insertion member for insertion of a corresponding end of the second insertion member therein. One end of the second insertion member inserted into the first insertion member is provided with a boss conformed to the internal contour of the holding groove so as to be locked into the holding groove.

Furthermore, an atomization device is disposed in the first stem body. The atomization device includes an atomization base pressed against the first insertion member and an electric heater coil secured on the atomization base. The atomization base is made of rubber material.

Preferably, the width of the side wall, on which the locking member is disposed, of the first insertion member is smaller than the diameter of the locking member. The atomization base extends toward the first insertion member so as to form a pressing member pressed against the internal opening of the locating hole in order to press the locking member inside the locating hole.

Preferably, the battery is disposed in the second stem body. One end of the first stem body opposing to the second stem body is further provided with a first electrode component which will electrically connect the atomization device and battery when the first and second stem bodies are connected with each other. The first electrode component includes a first electrode member and a second electrode member both of insulated from each other and connected respectively with the two ends of the electric heater coil so as to form a positive and negative electrodes of the atomization device.

Furthermore, the first electrode member is pressed against the atomization base and a first end of the electric heater coil is sandwiched between the two. The second electrode member is pressed against the atomization base and a second end of the electric heater coil is sandwiched between two.

Preferably, the first insertion member is made of conductive material and constitutes the first electrode member.

Preferably, a guiding hole is defined in a middle portion of the first insertion member and axially extends through the first insertion member. The middle portion of the atomization base extends to the first guiding hole so as to form an insulation portion. A second guiding hole is axially defined in the insulation portion and extends the atomization base.

The second electrode member passes through the second guiding hole and is insulated from the first insertion member by the insulation portion.

Furthermore, the battery is a rechargeable battery and another end of the second stem body far away from the first stem body is provided with a charging unit connected to the battery so as to charge the battery.

Preferably, the charging unit includes a charging coupler for connecting with an external power source. The charging coupler is connected to the battery by a charging control module.

Preferably, the second stem body is further provided with an atomization control unit electrically connected to the battery so as to supply power to or cut off power from the atomization device. The atomization control unit is disposed between the atomization base and battery. Alternatively, the atomization control unit is disposed on the battery at one side away from the atomization base.

Preferably, the atomization control unit includes an atomization control circuit and an atomization control switch associated with the atomization control circuit. The atomization control switch may be a capacitive sensor switch or gas flow sensor switch or button switch. The atomization control circuit is integrated into the atomization control switch. Alternatively, the atomization control unit also includes an atomization control circuit board connected to both of the battery and atomization control switch. The atomization control circuit is integrated into the atomization control circuit board.

To solve a further technical problem as described above, the present invention also discloses an electronic cigarette device including an electronic cigar case and electronic cigarette contained in the cigar case. Here, the electronic cigarette is the one as described above.

The invention has the following technical effects. A locking member of which the a protrusion end is arc-shaped is provided on the first stem body, thus realizing secure connection between the first and second stem bodies, making the structure simple, bringing out convenience in assembling and disassembling process and high stability. The battery is configured to be a rechargeable battery, and a charging unit is placed on the second stem body at one end thereof away from the first stem body, hereby realizing repeat use of the battery in the electronic cigarette, effectively improving lifespan of the electronic cigarette, and saving cost of the smoker spent on smoking.

The embodiments of the invention are described in detail in conjunction with the accompanying drawings.

DETAILED DESCRIPTION OF THE INVENTION

Figure 1:
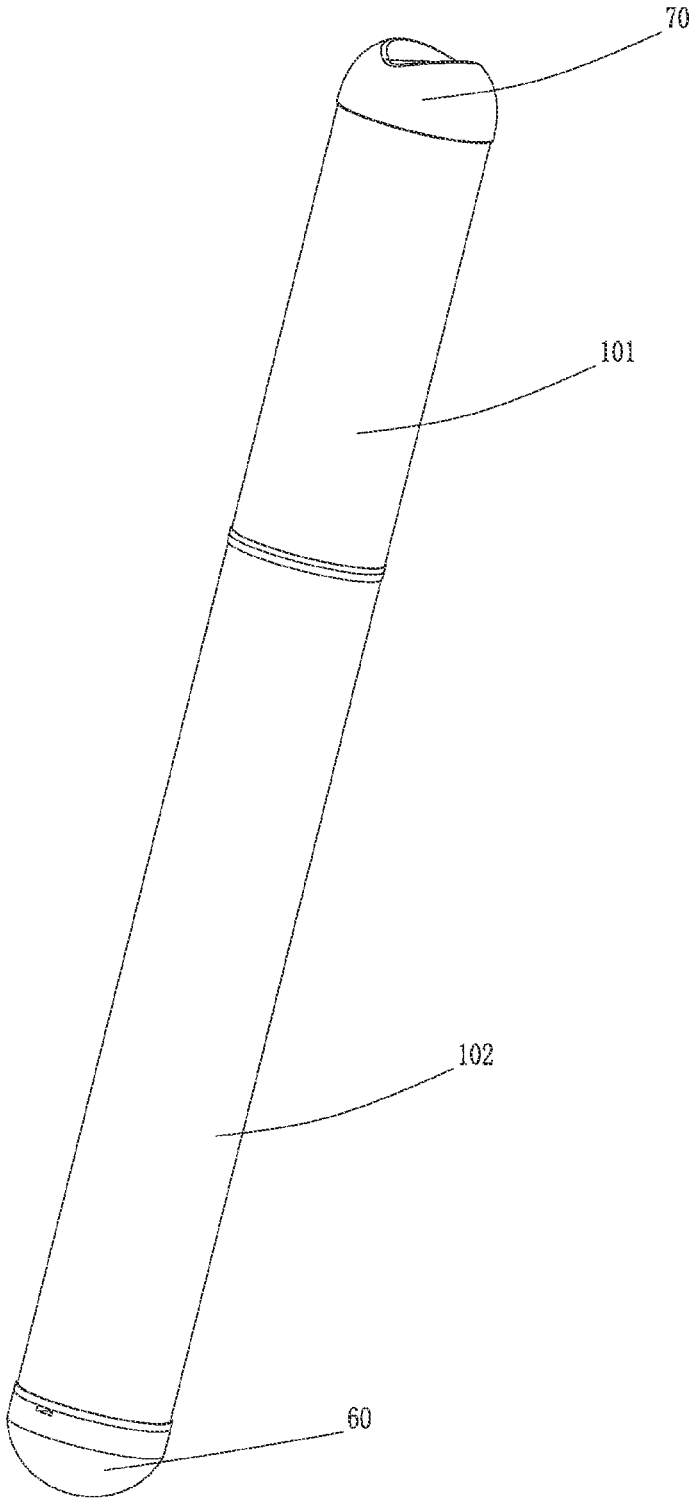
FIG. 1 is a schematic perspective view of an electronic cigarette of an embodiment of the invention.

As shown in FIGS. 1-12, the invention provides an electronic cigarette device including an electronic cigarette 100 and an electronic cigar case 200 for accommodating the former.

Referring to FIGS. 1-5, the electronic cigarette 100 of the embodiment includes a first stem body 101 and a second stem body 102 connected with the first stem body 101. The first and second stem bodies 101 and 102 are detachably connected with each other.

In this embodiment, both the first stem body 101 and second stem body 102 are configured to be of hollow cylindrical tubular construction so as to form respective receiving cavities for receiving internal components. Understandingly and as an embodiment, in addition to cylindrical shape of the embodiment, the first stem body 101 and second stem body 102 of the embodiment may also be configured to have any other tubular construction with hollow cavity. At the same time, the first stem body 101 and second stem body 102 may also be configured to have the same tubular construction. Alternatively, they may be configured to have different tubular construction.

Reference is made to FIGS. 2, 3, 6 and 7, the opposing ends of the first stem body 101 and second stem body 102 are provided with a first insertion member 11 and a second insertion member 12 respectively. The first insertion member 11 and a second insertion member 12 are matched with each other so as to stably connect the first stem body 101 and second stem body 102.

Specifically, a locking member 13 of which a protrusion end is arc-shaped is circumferentially disposed on a side wall of the first insertion member 11, while a side wall of the second insertion member 12 is correspondingly provided with a locking groove 14 engaged with the locking member 13 such that the locking member 13 is inserted therein.

As shown in FIGS. 6, 7, 9 and 10, in this embodiment, a holding groove 111 is defined in the first insertion member 11 for insertion of a corresponding end of the second insertion member 12 therein. One end of the second insertion member 12 inserted into the first insertion member 11 is provided with a boss 121 conformed to the internal contour of the holding groove 111 so as to be locked into the holding groove 111. As an embodiment, the holding groove may also be disposed on a corresponding end of the second insertion member 12, whereas the other end corresponding to the first insertion member 11 is provided with a boss 121 for insertion into the holding groove 111.

In this embodiment, the locking member 13 is disposed on an inner side wall of the holding groove 111, and the locking groove 14 is disposed on an external side wall of the boss 121. Understandingly, as an embodiment, the locking member 13 may also be disposed on the external side wall of the boss 121, and the locking groove is disposed on the inner side wall of the holding groove 111.

Figure 2:
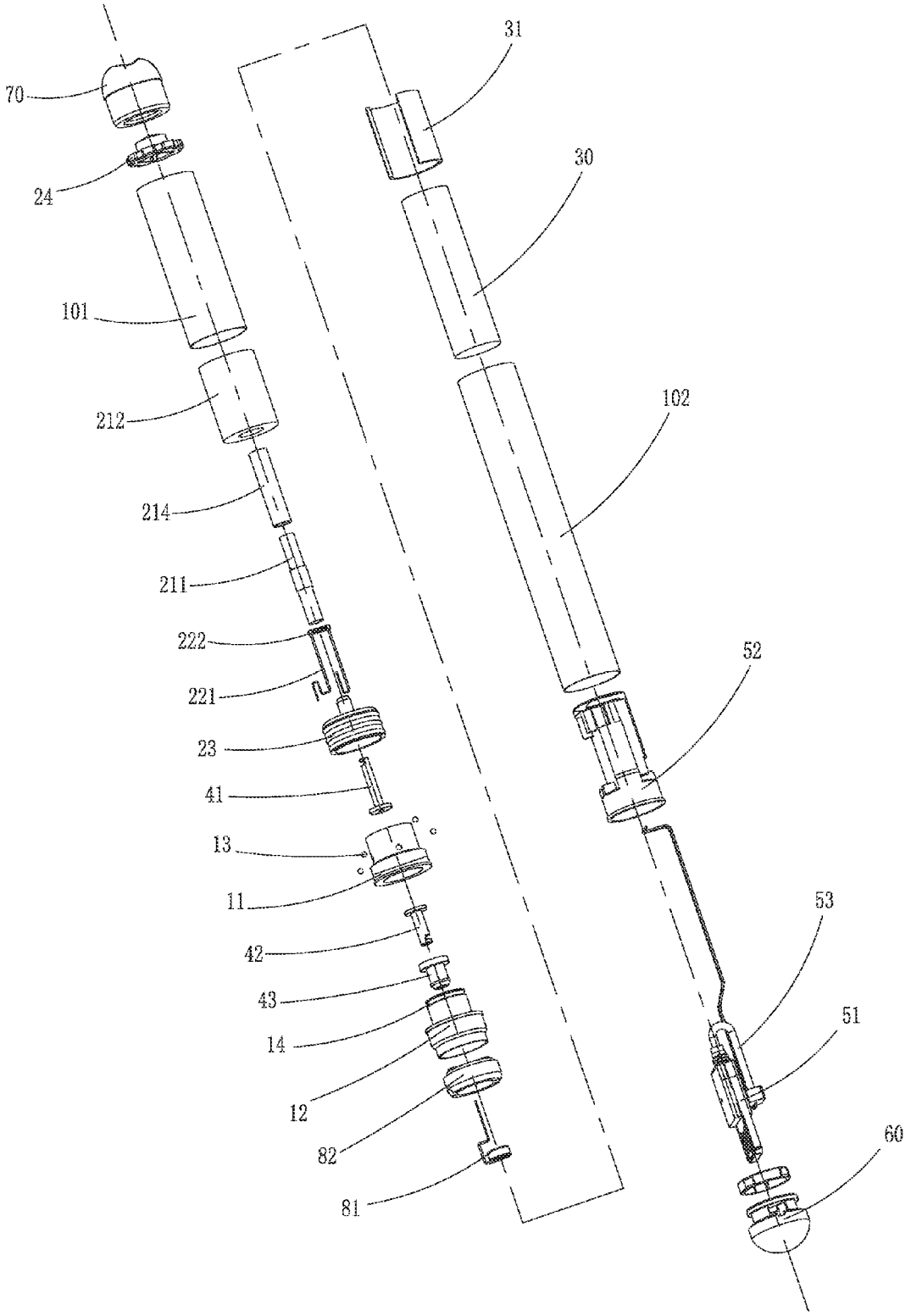
FIG. 2 is an exploded view of an electronic cigarette of an embodiment of the invention.
Figure 3:
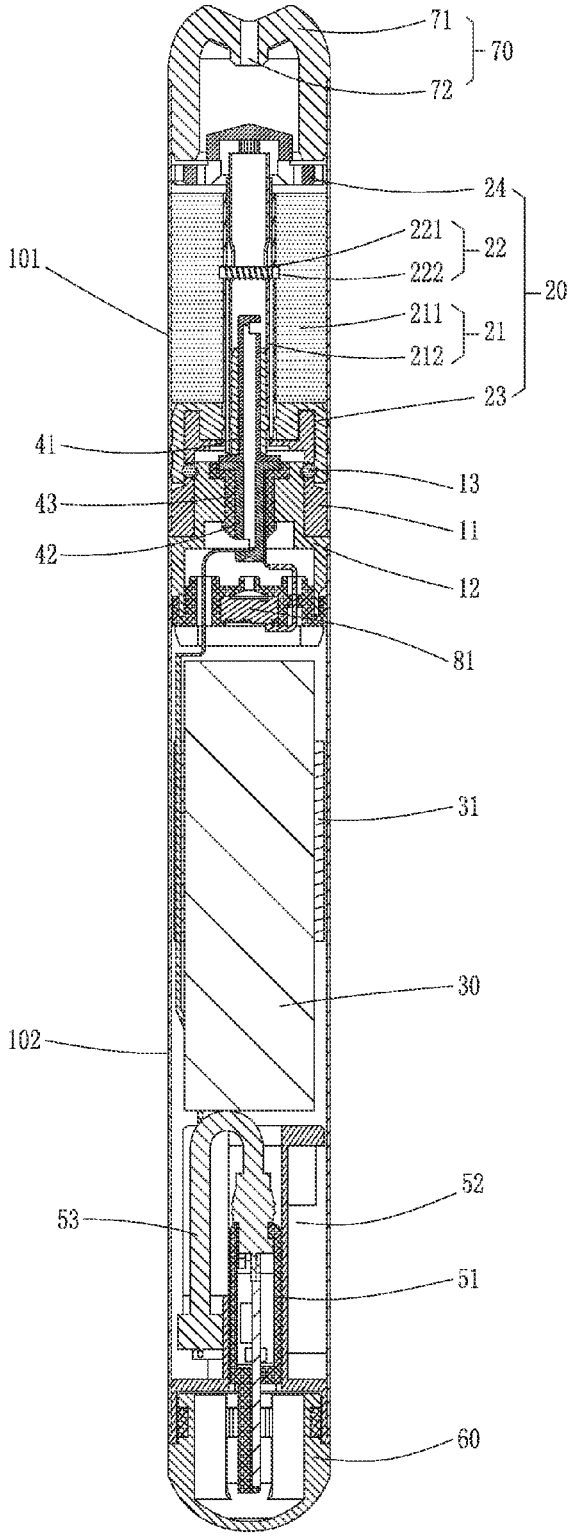
FIG. 3 is a cross-sectional view of an electronic cigarette of an embodiment of the invention.
Figure 4:
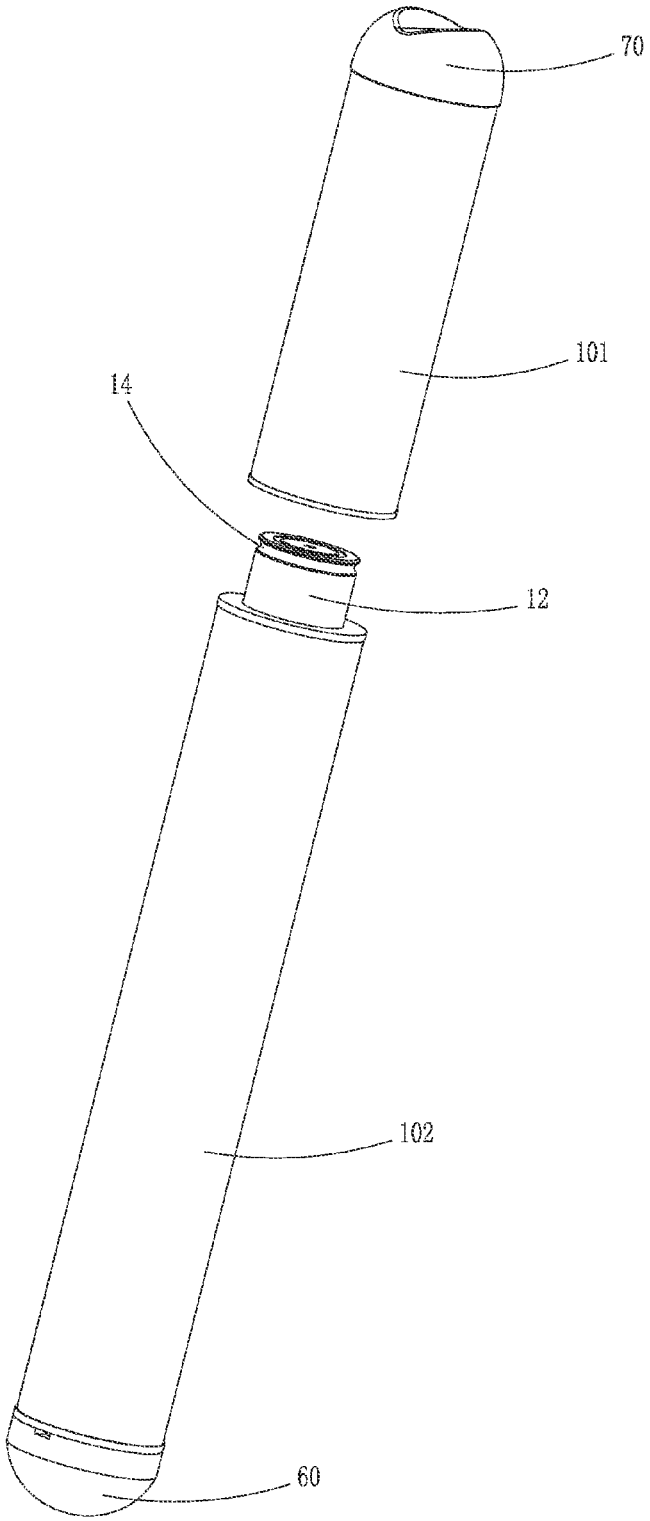
FIG. 4 is a schematic view showing connection between a first stem body and a second stem body of an electronic cigarette of an embodiment of the invention.
Figure 6:
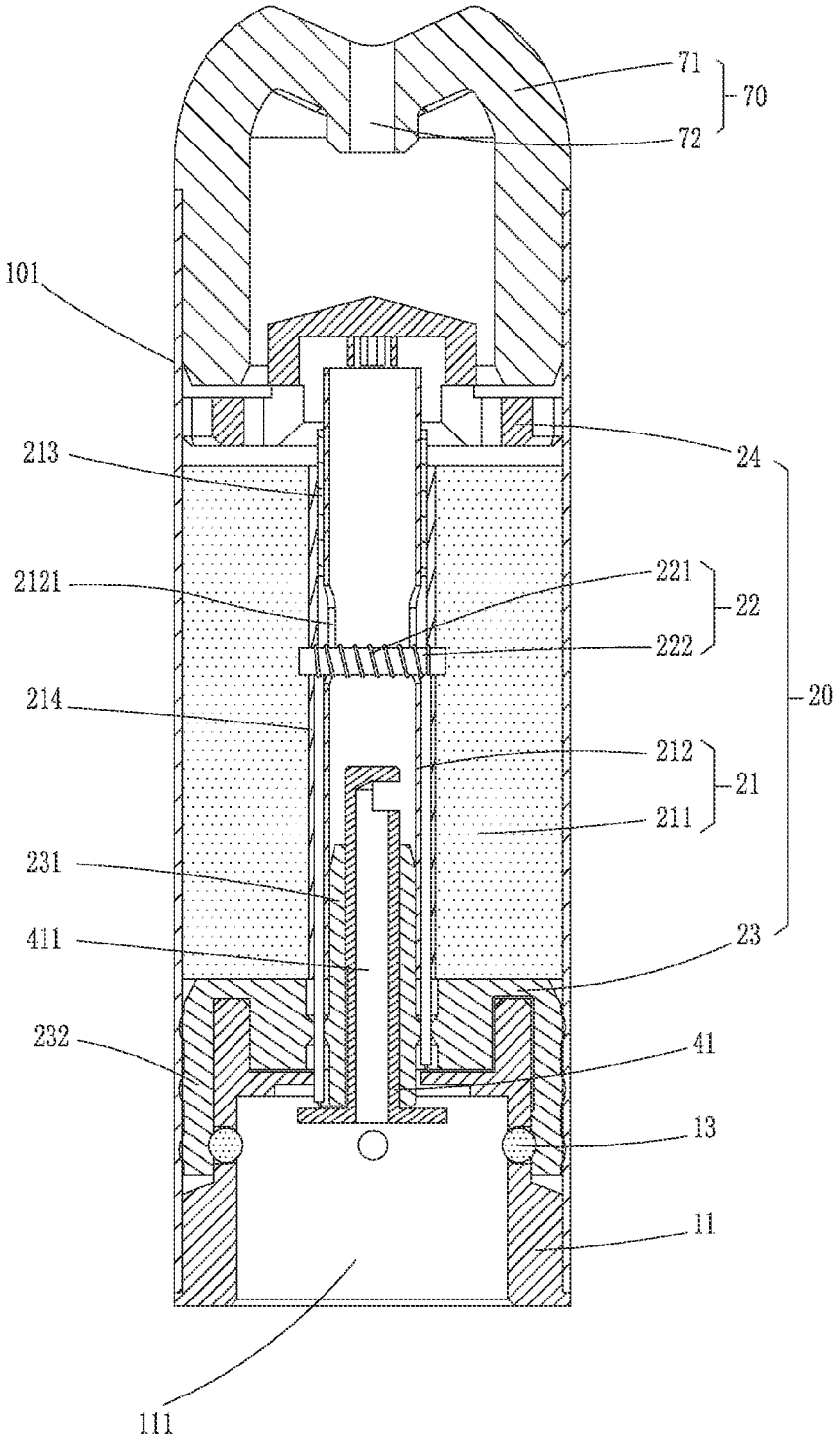
FIG. 6 is a cross-sectional view of a first stem body of an electronic cigarette of an embodiment of the invention.
Figure 9:
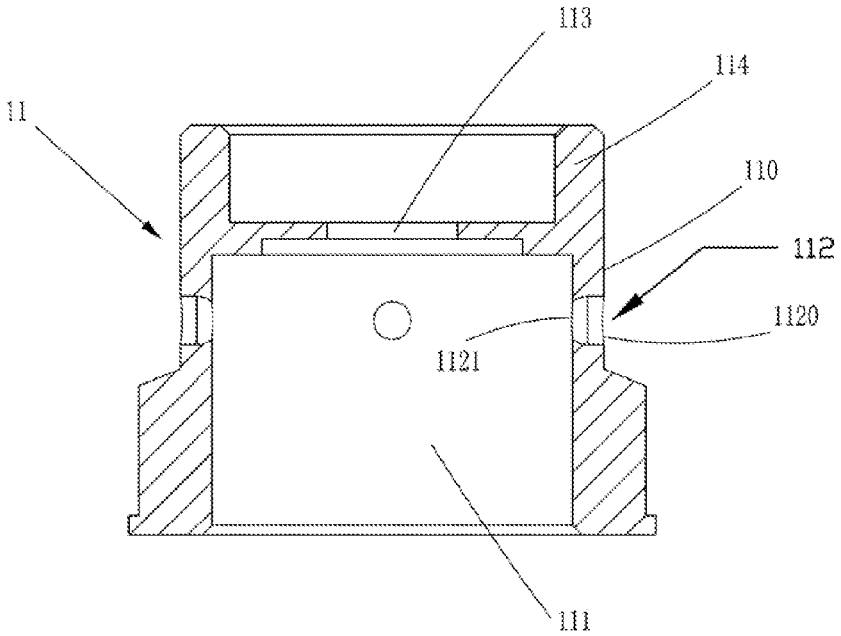
FIG. 9 is a cross-sectional view of a first insertion member of an electronic cigarette of an embodiment of the invention.

Please refer to FIGS. 2, 3 and 6. In this embodiment, the locking member 13 is a plurality of separated spherical bodies circumferentially, independently and evenly arranged on the first insertion member 11. As shown in FIG. 9, a corresponding number of locating holes 112 are defined in the side wall of the first insertion member 111. The locating holes pass through the side wall of the first insertion member 11 and its outer diameter is smaller than a diameter of the locking member 13 so as to receive and secure the locking member 13 therein and let one end of the locking member 13 to be extended out of the locating hole 112, thus making the locking member 13 be engaged with the locking groove 14. When placing the locking member 13, to realize easy connection between the first insertion member 11 and the second insertion member 12.

When placing the locking member 13, to make easy connection between the first insertion member 11 and the second insertion member 12, one side as an inner protrusion end 130 of the locking member 13 adjacent an inner opening 1120 of the locating hole 112 is provided with a resilient pressing member 232 for resiliently pressing the locking member 13 inside the locating hole 112. When the boss 121 of the second insertion member 12 is inserted into the holding groove 111 of the first insertion member 11, an outer side wall of the boss 121 pushes the locking member 13. Under the external force of the locking member 13, the resilient pressing member 232 is compressed and the external force applied on the resilient pressing member 232 will be reduced or eliminated when the locking groove 14 aligns with the locking member 13, thus further urging the locking member 13 returning to its original position and an outer protrusion end 131 opposite the protrusion inner end 130 of the locking member 13 is pressed against the locking groove 14. By this manner, the first insertion member 11 and the second insertion member 12 connected with each other.

As an embodiment, it is also possible to set only one end of the locking member 13 facing an outer opening 1121 of the locating hole 112 to be spherical, and another end thereof close to the inner opening 1120 of the locating hole 112 is not limited to specific shape so long as the locking member 13 can be received in the locating hole 112 and one end 131 of the locking member 13 located at the outer opening 1121 of the locating hole 112 extends out of the locating hole 112 and engages the locking groove 14. Alternatively, the locking member 13 may also be directly disposed on the first insertion member 11. That is, the locking member 13 is integrally formed with the first insertion member 11 during manufacture of the first insertion member 11.

As shown in FIG. 3, an atomization device 20 for changing cigar liquid into smoke is placed in the first stem body 101. A battery 30 electrically connected with the atomization device 20 so as to provide power to the atomization device 20 is positioned in the second stem body 102.

Referring to FIG. 6, in this embodiment, the atomization device 20 includes an atomization cup 21, an atomizer 22 received in the atomization cup 21, an atomization bushing sleeved on the atomization cup 21, and an atomization base 23 and an atomization case 24 located respectively at two ends of the atomization cup 21 for sealing and securing the atomization cup 21 inside the atomization bushing.

The atomization bushing is sleeved on the outside of the atomization cup 21 and atomization base 23 for providing the atomization device 20 with a cup body for placing and sealing cigar liquid. In this embodiment, the atomization bushing is directly formed by the first stem body 101. Of course, the atomization bushing may also be formed separately.

The atomization cup 21 serves to store cigar liquid and includes a liquid storage component 211 and a supporting tube 212. In this embodiment, the liquid storage component 211 and supporting tube 212 are substantially of hollow tubular structure and they are arranged in the first stem body 101 in turn.

The liquid storage component 211 is able to absorb and store cigar liquid and is intended to absorb and store cigar liquid so that the liquid will be atomized later by the atomizer 22. In this embodiment, the liquid storage component 211 may be made of material having liquid absorption and storage ability such as glass fiber, high temperature resistant cotton, chemical fiber cotton, mixed cotton, liquid absorption cotton and foam nickel.

The supporting tube 212 is made of glass fiber. The supporting tube 212 is inserted into the liquid storage component 211 for conducting gas and supporting and holding the liquid storage component 211.

The atomizer 22 is used for converting cigar liquid into smoke and includes an electric heater coil 221 and an atomization stem 222. The electric heater coil 221 is enwound on the atomization stem 222 and is located and held in the atomization cup 21 via the atomization stem 222. In present embodiment, the atomization stem 222 is configured to have a cylindrical shape and is constructed of glass fiber or other high temperature resistant fiber material for absorbing cigar liquid to be heated and atomized by the electric heater coil 221.

As shown in FIG. 6, in present embodiment, the atomization stem 222 is radially disposed in the supporting tube 212. A middle side wall of the supporting tube 212 is correspondingly provided with a holding slot 2121 which extends radially through the side wall. The two ends of the atomization stem 222 extend out of the supporting tube 212 from the holding slot 2121 and are pressed against an inner wall of the liquid storage component 211 so as to absorb cigar liquid in the component to be heated and atomized by the electric heater coil 221. Meanwhile, to avoid axial movement of the atomization stem 222 in the supporting tube 212, a locating tube 213 is sleeved on the supporting tube 212 at a location above or below the atomization stem 222. One end of the locating tube 213 is pressed against the atomization stem 222 for pressing the atomization stem 222 against the holding slot 2121 of the supporting tube 212. In this embodiment, to facilitate placement of the electric heater coil 221 and save space, the locating tube 213 is preferably sleeved on a location above the atomization stem 222. As an embodiment, the atomization stem 222 may also be axially disposed in the supporting tube 212. When the atomization stem 222 is axially arranged, it should be ensured that the electric heater coil 221 will sufficiently contact the inner wall of the supporting tube 222 so as to ensure the interior of the supporting tube 212 will be communicated with the gas path while the electric heater coil 221 sufficiently contacting the inner wall of the supporting tube 212.

Please continue referring to FIG. 6, as the temperature is very high when the electric heater coil 221 is powered to atomize the cigar liquid, to enhance the lifespan and heat resistance of the liquid storage component 211, a heat insulation member 214 is positioned between the liquid storage component 211 of the embodiment and supporting tube 212. The heat insulation member 214 is made of high temperature resistant and liquid absorptive material such as high temperature resistant cotton or Non-woven fabrics.

The atomization base 23 is secured at one end of the atomization cup 21 for supporting and holding the atomization cup 21 and electric heater coil 211 in the first stem body (i.e., the atomization bushing). The middle portion of the atomization base 23 extends towards the interior of the supporting tube 212 so as to form a locating post 231 of which the outer diameter is commensurate with the inner diameter of the supporting tube 212 for supporting and securing the supporting tube 212.

The atomization case 24 is disposed at another end of the atomization cup 21 far away from the atomization base 23 so as to engage the atomization base 23 to seal and hold the atomization cup 21 into the first stem body 101.

In this embodiment, the atomization base 23 is made of rubber material having certain resilient deformation ability such as silica gel, and its outer contour conforms to the inner contour of the first stem body 101 and it is preferable that the outer contour and inner contour be interference fitted with each other. The atomization base 23 is pressed against and secured in the first stem body 101 by its outer wall so as to realize sealable connection with the first stem body 101. The atomization case 24 is also made of rubber material having certain resilient deformation ability such as silica gel and is pressed against and secured to the first stem body 101.

Figure 8:
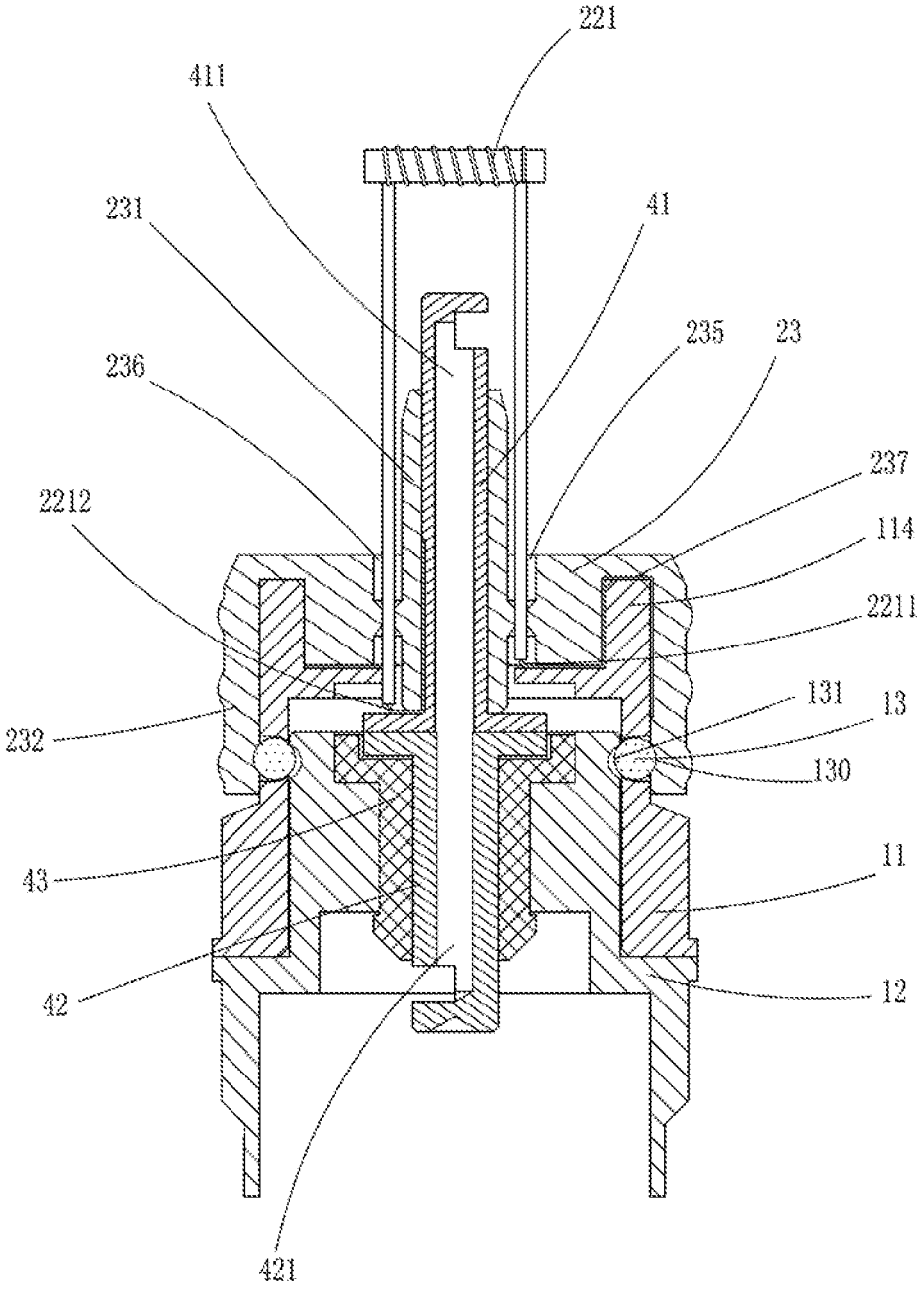
FIG. 8 is a view showing connection among a first electrode component, a second electrode component and an electric heater coil of an electronic cigarette of an embodiment of the invention.

Referring to FIG. 8, in this embodiment, a thickness of the side wall of the holding groove 111 of the first insertion member 11 is smaller than the diameter of the locking member 13. One end of the atomization base 23 pressed against the first insertion member 11 extends towards the first insertion member 11 such that a pressing member 232 is formed which is pressed against the inner opening of the locating hole 112 so as to push the locking member 13 into the locating hole 112. The pressing member 232 is just the resilient pressing member serving to resiliently push the locking member 13 into the locating hole 112. The resilient pressing member may also be configured as an independent compression spring pressed against the locking member 13. Optionally, it may also be other resilient part capable of resiliently being contracted and automatically restored to its original location. Of course, in case that the length of the locking member 13 extended out of the locating hole 112 is suitable, the locking member 13 may be directly placed into the locating hole 112 through the first insertion member 11, first stem body 101 or other adjacent component without arrangement of the resilient pressing member.

Please refer to FIGS. 3 and 6. In this embodiment, one side of the atomization base 23 away from the atomizer 22 is provided with a first electrode component. The first electrode component is electrically connected as the positive and negative electrodes of the atomization device 20 to the positive and negative electrodes of the battery 30.

Specifically, as shown in FIGS. 6 and 8, the first electrode component includes a first and a second electrode members 41 connected respectively to the two ends of the electric heater coil 221 so as to constitute the positive and negative electrodes of the atomization device 20. Both of the first and second electrode members 41 are constructed of conductive material and are insulated from each other. The first electrode member is pressed against the atomization base 23 for sandwiching a first end 2211 of the electric heater coil 221 between the first electrode member and atomization base 23. The second electrode member 41 is pressed against the atomization base 23 for sandwiching a second end 2212 of the electric heater coil 221 between the second electrode member and atomization base 23. By this manner, the first and second electrode members 41 are electrically connected with the electric heater coil 221 and finally form the positive and negative electrodes of the atomization device 20.

In this embodiment, the first insertion member 11 is made of conductive material and forms the first electrode member. In particular as shown in FIG. 9, the middle portion of the first insertion member 11 (that is, the first electrode member) is provided with a first guiding hole 113 axially extended through the first insertion member 11. The second electrode member 41 is held in the first guiding hole 113 of the first insertion member 11. The second electrode member 41 is of a hollow tubular construction and a first intake hole 411 through which external air comes in the atomization device 20 is defined in the middle hollow portion of the member 41.

Figure 11:
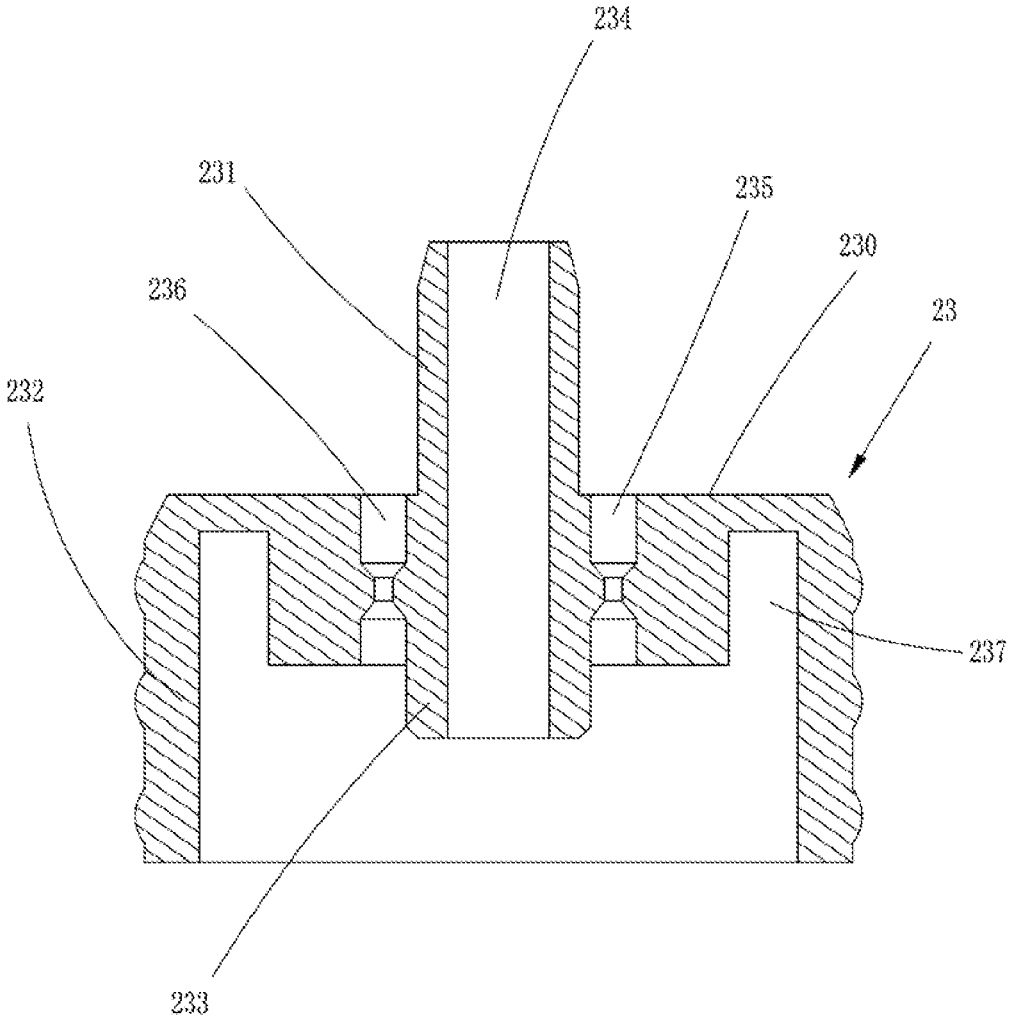
FIG. 11 is a cross-sectional view of an atomization base of an electronic cigarette of an embodiment of the invention.

In this embodiment, the first insertion member 11 and the second electrode member 41 both are insulated from each other by the atomization base 23. Concretely, as shown in FIG. 11, the middle portion of the atomization base 23 axially extends upwards to the first guiding hole 113 of the first insertion member 11 so as to define an insulation portion 233 as a bottom part of the locating post 231. A second guiding hole 234 axially extended through the atomization base 23 is defined through the middle portion of the locating post 231. The second electrode member 41 in a tubular shape passes through the second guiding hole 234 and is insulated from the first insertion member 11 by the insulation portion 233. Of course, as an embodiment, the first insertion member 11 and second electrode member 41 may also be insulated from each other by a stand-alone insulation member.

Please further refer to FIG. 11. A first wire guiding hole 235 and a second wire guiding hole 236 are axially defined in a bottom wall 230 of the atomization base 23 for passing through the two ends of the electric heater coil 221. The two ends of the electric heater coil 221 passes across the first wire guiding hole 235 and second wire guiding hole 236 respectively and are connected to the first insertion member 11 and second electrode member 41.

In this embodiment, the atomization base 23, first insertion member 11 and second electrode member 41 are held in the first stem body 101 by pressing against each other due to construction of the atomization base 23 with rubber material having certain resilient deformation ability. The two ends of the electric heater coil 221 are directly locked between the atomization base 23 and first electrode member 41 by interaction of the atomization base 23 with the first insertion member 11 and second electrode member 41. In addition, the two ends of the electric heater coil 221 are secured to the first insertion member 11 and second electrode member 41 respectively, thus achieving electrical connection with the positive and negative electrodes of the battery 30.

Specifically, as shown in FIGS. 8-11, the atomization base 23 is cylindrical, comprises the bottom wall 230, a downwards annular side wall 232 from a periphery of the bottom wall 230, and the locating post 231 axially through the bottom wall 230, and the side wall 232 is used as the pressing member in this embodiment. A holding groove 237 is defined at one end of the atomization base 23 facing the first insertion member 11. A top end of the first insertion member 11 facing the atomization base 23 extends towards the holding groove 237 such that a holding wall 114 as a top part of the side wall 110 of the first insertion member 11 is formed. There is interference fit between the holding wall 114 and holding groove 237, namely, the first insertion member 11 is fitted in the atomization base 23, and the first guiding hole 113 of the first insertion member 11 and the second guiding hole 234 of the atomization base 23 are communicated with each other. One end of the second electrode member 41 opposing to the atomization base 23 extends into the second guiding hole 234 located at the middle portion of the locating post 231 and is interference fitted with the second guiding hole 234, namely, the hollow tubular second electrode member 41 is fitted in the locating post 231 of the atomization base 23. When mounting and holding the electric heater coil 221, the first end 2211 of the electric heater coil 221 passes across the first wire guiding hole 235 and then is bent towards inside of the holding groove 237. Secure connection between the electric heater coil 221 and first insertion member 11 is realized by mutual compression between the holding wall 114 and the holding groove 237. Correspondingly, the second end 2212 of the electric heater coil 221 passes across the second wire guiding hole 236 and then is bent towards the second guiding hole 234. Therefore, secure connection between the electric heater coil 221 and second electrode member 41 is realized by mutual compression between the second electrode member 41 and the second guiding hole 234.

As the outer contour of the atomization base 23 matches with the inner contour of the first stem body 101 and preferably they are interference fitted with each other, the first electrode component can be pressed against and secured in the first stem body 101 by mutual compression between the atomization base 23 and the first electrode component, thus realizing sealable connection with the first stem body 101 and this further avoiding using of individual seal structure such as seal ring which otherwise will result in some drawbacks for example increased cost and poor sealing property.

Reference is made to FIG. 3. One end of the second stem body 102 connected to the first stem body 101 is provided with a second electrode component which connects to the battery 30. The second electrode component is connected to the first electrode component, thus realizing electrical connection between the battery 30 and atomization device 20.

Figure 7:
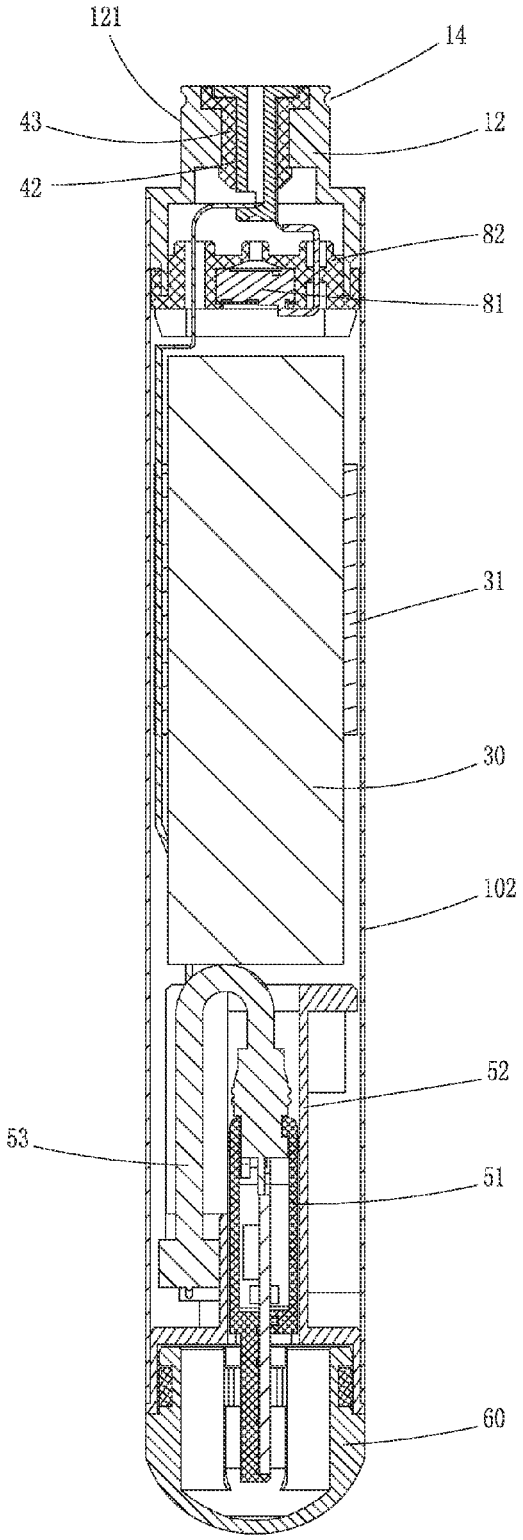
FIG. 7 is a cross-sectional view of a second stem body of an electronic cigarette of an embodiment of the invention.

Specifically, as shown in FIGS. 7 and 8, the second electrode component includes a third electrode member and a fourth electrode member 42 correspondingly connected to the positive and negative electrodes of the battery 30 and atomizer 32. The third electrode member and forth electrode member 42 are all made of conductive material and they are insulated from each other by an insulation sleeve 43.

Figure 10:
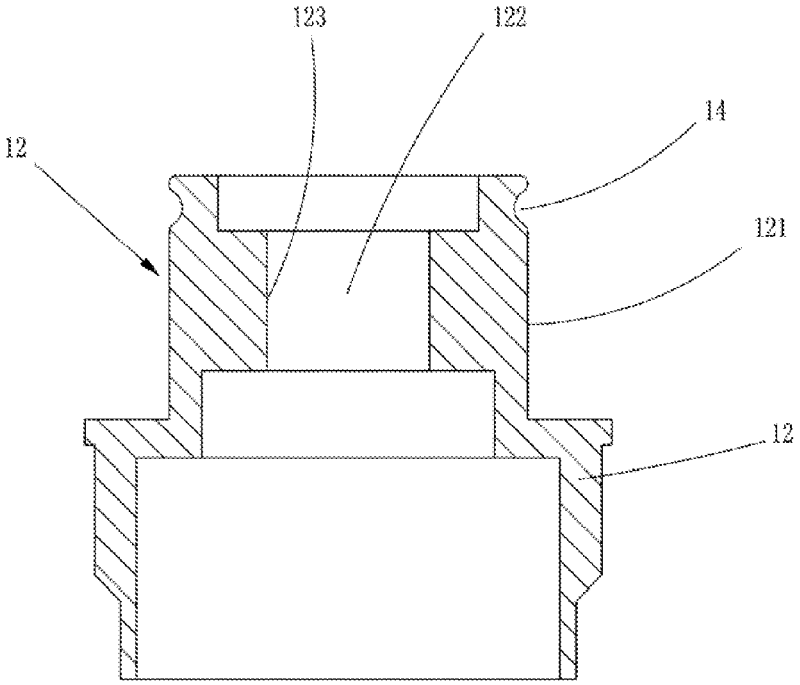
FIG. 10 is a cross-sectional view of a second insertion member of an electronic cigarette of an embodiment of the invention.

In present embodiment, the second insertion member 12 is made of conductive material and forms the third electrode component. As shown in FIG. 10, a third guiding hole 122 is defined in the middle portion of the second insertion member 12 (that is, the third electrode member) and axially extends through the second insertion member 12. The inner wall of the third guiding hole 122 radially extends to form a locking ring 123 for holding the insulation sleeve 42. The fourth electrode member 42 is arranged corresponding to the second insertion member 12, and is secured at the middle portion of the second insertion member 12 by the insulation sleeve 43. The fourth electrode member 42 is also of a hollow tubular construction. A second intake hole 421 is defined in the middle portion of the fourth electrode member 42 for communicating the first intake hole 411 and realizing conduction of the gas path.

When assembling the electronic cigarette 100, the boss 121 is placed into the holding groove 111. The first insertion member 11 is pressed against and connected to the second insertion member 12. The second electrode member 41 is pressed against and secured to the fourth electrode member 42, thus realizing electrical connection of the atomization device 20 with the positive and negative electrodes of the battery 30.

In this embodiment, the battery 30 is a rechargeable battery, and is formally mounting in the second stem body 102 through a battery mounting base 31. A charging unit connected to the battery 30 is provided at another end of the second stem body 102 far away from the first stem body 101.

As shown in FIGS. 2, 3, 5 and 7, the charging unit includes a charging coupler 51 and a charging control module. One end of the charging coupler 51 is connected to the battery 30 through the charging control module so as to prevent overcharging of the battery 30, while the other end thereof is intended for connection with an external power source in order to charge the battery 30.

Figure 5:
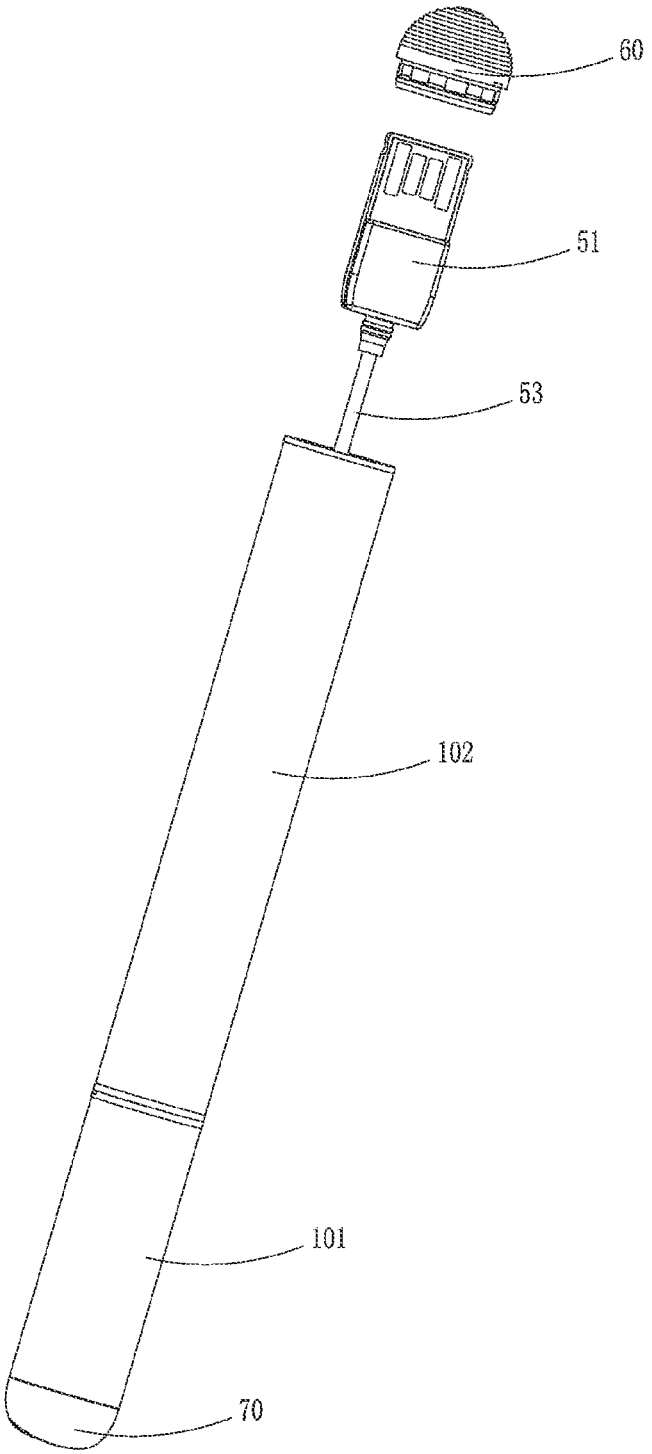
FIG. 5 is a schematic view showing connection between a second stem body and a light cap of an electronic cigarette of an embodiment of the invention.

In present embodiment, the charging coupler is preferably configured to be a USB port as shown in FIGS. 2 and 5. As an embodiment, the charging coupler may also be configured to be any other connector port matched with data line or power supply setting port.

As shown in FIGS. 2, 3 5 and 7, the charging coupler is disposed in another end of the second stem body 102 far away from the first stem body 101. A holding member 52 matched with the charging coupler 51 for securing the charging coupler 51 is disposed in the second stem body 102. The holding member 52 is electrically connected to the battery 30 through a connection wire 53. When the battery 30 is charged, the charging coupler 51 may be drawn out of the second stem body 102 so as to facilitate insertion and pull of the charging coupler 51.

Please refer to FIGS. 1, 2 and 9, another end of the second stem body 102 far away from the first stem body 101 is provided with a light emitting device which functions as a working indicator light of the electronic cigarette 100. The light emitting device includes a light emitting unit electrically connected to the battery 30 and a light cap 60 disposed at corresponding end of the second stem body 102. In this embodiment, the light cap 60 is connected to the second stem body 102 by means of clasping. As an embodiment, the light cap 60 may also be connected to the second stem body 102 by means of screwing, insertion or magnetic adsorption. The end portion of the light cap 60 is designed to be transparent or semitransparent such that light of the light emitting unit can be emitted therefrom. In present embodiment, the light emitting unit is designed to be a red lamp such that when the smoker smokes the electronic cigarette 100, red smoke circles like those produced when a cigar is burned are generated, hence enhancing visual effects of the smoker.

In addition, the light cap 60 also engages the second stem body 102 such that the charging coupler 51 is covered on the end portion of the second stem body 102. It is understandable that when the electronic cigarette is not provided with the light emitting device, the charging coupler 51 will be covered on the end portion of the second stem body 102 by a cover body detachably connected to the second stem body 102.

As shown in FIGS. 1-6, a mouthpiece 70 is disposed at one end of the first stem body 101 far away from the second stem body 102. In present embodiment, the mouthpiece 70 is designed to be independent of the first stem body 101, and it includes a nozzle case 71 disposed on the end portion of the first the stem body 101 and a suction hole 72 axially defined in the middle portion of the nozzle case 71. As an embodiment, the mouthpiece 70 may also be integrally formed with the first stem body 101. In present embodiment, the mouthpiece 70 is designed to be of a cylindrical construction. It is understandable that the mouthpiece 70 may also be designed to be of any tubular construction with hole such as polygon and ellipse. Alternatively, it may also be designed such that the diameter becomes smaller and smaller towards the end portion of the mouthpiece 70 so as to form a sleeve construction having predefined taper.

As shown in FIGS. 3 and 7, an atomization control unit may be disposed in the second stem body 102. The atomization control unit is electronically connected to the battery 30 and atomization device 30 respectively so as to supply power to or cut off power from the atomization device 20. The atomization control unit may also be disposed between the atomization device 20 and battery 30. Optionally, it may also be disposed at one end of the battery 30 away from the atomization device 20.

In present embodiment, the atomization control unit is preferably disposed between the atomization device 20 and battery 30. The atomization control unit includes an atomization control circuit and an atomization control switch connected to the atomization control circuit.

In this embodiment, the atomization control switch is a sensor switch 81 held in the second stem body 102 by a switch holding base 82. Specifically, the sensor switch 81 is a capacitive sensor switch. When the electronic cigarette 100 is being used by a user, the capacitive sensor switch senses the capacitance change caused by incoming gas flow and then the switch controls the atomization control circuit to switch on a power supply, thus making the electronic cigarette 100 entering into working status. As an embodiment, the sensor switch 81 may also be a gas flow sensor switch. When the user inhales gas by the mouthpiece 70, negative pressure is generated inside the cavity of the electronic cigarette 100 and in turn, the gas flow sensor switch generates pulse signals to control the atomization control circuit to switch on a power supply.

As the sensor switch 81 in itself is precisely fabricated and generally, a dedicated controller is built therein, the atomization control circuit of this embodiment may be directly integrated into the controller of the sensor switch 81. As an implementation manner, the atomization control circuit may also be integrated into a sensor control circuit board separately disposed outside of the sensor switch 81 and electrically connected to both of the sensor switch 81 and battery 30.

As an implementation manner, the atomization control switch may also be a conventional switch of button type. The button switch is electrically connected to the battery 30 through a button control circuit board such that the atomization control circuit is controlled by pressing the buttons, thus realizing switching on and off of the atomization device 20.

Below, one end of the battery 30 electrically connected to the fourth electrode member 42 is defined as a positive electrode, while the other end thereof electrically connected to the second insertion member 12 is defined as a negative electrode. In addition, the atomization control switch is configured to be a sensor switch 81. The current flow routing of the electronic cigarette 100 is described in detail.

When the smoker smokes the electronic cigarette 100, the sensor switch 81 will sense and switch on the atomization control circuit. The detailed current flowing path is as below: the current arrives at the fourth electrode member 42 from the positive electrode of the battery 30, then travels to the positive electrode of the electric heater coil 221 via the second electrode member 41, next flows to the first insertion member 11 via the negative electrode of the electric heater coil 221 and finally, comes back to the negative electrode of the battery 30 through the second insertion member 12.

Understandingly, the electronic cigarette 100 of the invention is not limited to the embodiments shown in FIGS. 1-11. Rather, individual features of these embodiments may be combined with each other to form new embodiments.

Figure 12:
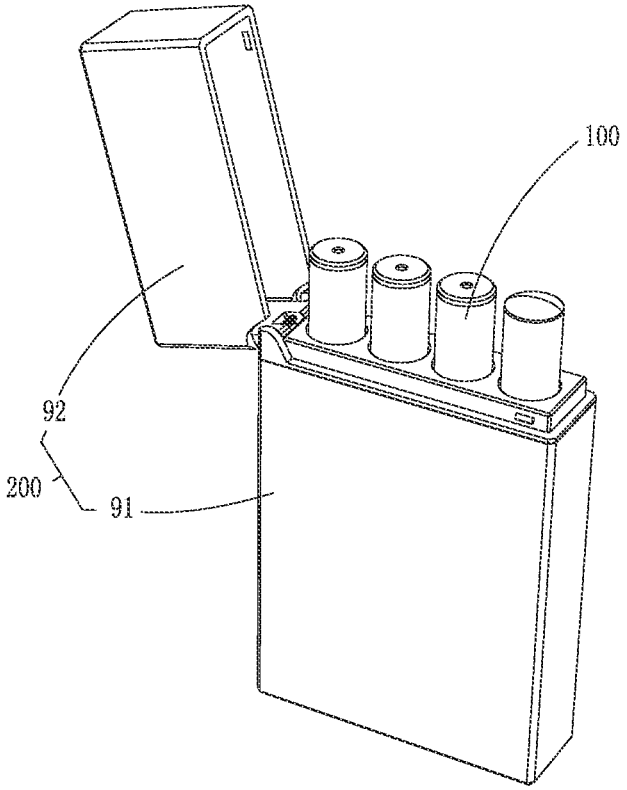
FIG. 12 is a perspective view of an electronic cigarette of an embodiment of the invention.

As shown in FIG. 12, the electronic cigarette 100 is in general contained in the electronic cigar case 200. The cigar case 200 includes a bottom box 91 for containing therein the electronic cigarette 100 and a case lid 92 covered on the bottom box 91. The bottom box 91 is of a square enclosure and of course, it is not limited to square. Rather, it may also take on circle, ellipse, polygon and the like so long as the case lid 92 will match it when the case lid 92 is installed.

Though various embodiments of the invention have been illustrated above, a person of ordinary skill in the art will understand that, variations and improvements made upon the illustrative embodiments fall within the scope of the invention, and the scope of the invention is only limited by the accompanying claims and their equivalents.

What is claimed is:

1. An electronic cigarette comprising connected first and second tubular stem bodies; wherein opposing ends of the first and second stem bodies are respectively provided with a first and a second insertion members; the first insertion member and the second insertion member are matched with each other whereby the first and second stem bodies are stably connected with each other;

a plurality of separated spherical bodies are circumferentially and independently provided in a side wall of the first insertion member, a plurality of locating holes are accordingly defined in the side wall of the first insertion member; the locating holes pass through the side wall of the first insertion member; each spherical body is received one locating hole with both opposite ends of the spherical body oppositely extending outwards as an inner protrusion end and an outer protrusion end thereof;

the protrusion ends of the spherical body are arc-shaped;

a locking groove is correspondingly defined around a side wall of the second insertion member; the locking groove is engaged with the plurality of spherical bodies in the way that the plurality of spherical bodies are inserted therein;

a resilient pressing member is provided outer of the first insertion member, and resiliently presses against the inner protrusion end of each spherical body; the resilient pressing member is capable of being resiliently contracted and automatically restored to its original location;

an outer diameter of each locating hole is smaller than a diameter of each spherical body, and the spherical bodies are respectively received in the locating holes with the outer protrusion ends thereof extend out;

the pressing member is an annular wall, and is fitted around the sidewall of the first insertion member from a top end of the first insertion member; the second insertion member is inserted in the first insertion member from an opposite bottom end of the first insertion member; the plurality of spherical bodies are secured in the locating holes of the first insertion member and between both the pressing member and the second inserted member, the pressing member resiliently presses against the inner protrusion end of each spherical body, and the outer protrusion end of each spherical body is tightly fitted in the locking groove of the second insertion member, whereby the first insertion member and the second insertion member are connected each other.

2. The electronic cigarette as recited in claim 1, wherein a holding groove is defined in the first insertion member for insertion of a corresponding end of the second insertion member therein; one end of the second insertion member inserted into the first insertion member is provided with a boss conformed to the internal contour of the holding groove so as to be locked into the holding groove.

3. The electronic cigarette as recited in claim 1, wherein an atomization device is disposed in the first stem body; the atomization device includes an atomization base pressed against the first insertion member and an electric heater coil secured on the atomization base; and the atomization base is made of rubber material.

4. The electronic cigarette as recited in claim 3, wherein the width of the side wall, on which the plurality of spherical bodies is disposed, of the first insertion member is smaller than the diameter of each spherical body; the atomization base extends downwards to the first insertion member and forms the pressing member pressed against an inner opening of the locating hole in order to press the plurality of spherical bodies inside the locating holes.

5. The electronic cigarette as recited in claim 3, wherein a battery is disposed in the second stem body; the top end of the first stem body opposing to the second stem body is further provided with a first electrode component which electrically connects with the atomization device and the battery when the first and second stem bodies are connected with each other; and the first electrode component includes a first electrode member and a second electrode member which are insulated from each other and connected respectively with two ends of the electric heater coil so as to form a positive and negative electrodes of the atomization device.

6. The electronic cigarette as recited in claim 5, wherein:

the atomization base is cylindrical, comprises a bottom wall, a downwards annular side wall from a periphery of the bottom wall, and a locating post axially through the bottom wall;

a first guiding hole axially extends through the first insertion member;

a second guiding hole axially extends through the locating post of the atomization base;

the top side wall of the first insertion member is fitted in the downwards annular side wall of the atomization base, and the first guiding hole of the first insertion member and the second guiding hole of the atomization base are communicated with each other;

the hollow tubular second electrode member is inserted in the locating post of the atomization base;

the first electrode member is pressed against the bottom wall and the annular side wall of the atomization base and a first end of the electric heater coil is sandwiched therebetween; and an outer wall of the second electrode member is pressed against an inner wall of the locating post of the atomization base and a second end of the electric heater coil is sandwiched therebetween; and the first insertion member is used as the first electrode member.

7. The electronic cigarette as recited in claim 6, wherein the downwards annular side wall of the atomization base is used as the pressing member.

8. The electronic cigarette as recited in claim 7, wherein the atomization base, the first insertion member and the second electrode member are held in the first stem body by pressing against each other due to construction of the atomization base with rubber material having certain resilient deformation ability.

9. The electronic cigarette as recited in claim 5, wherein the battery is a rechargeable battery and another end of the second stem body far away from the first stem body is provided with a charging unit connected to the battery so as to charge the battery.

10. The electronic cigarette as recited in claim 9, wherein the charging unit includes a charging coupler for connecting with an external power source; and the charging coupler is connected to the battery by a charging control module.

11. The electronic cigarette as recited in claim 5, wherein the second stem body is further provided with an atomization control unit electrically connected to the battery so as to supply power to or cut off power from the atomization device; the atomization control unit is disposed between the atomization base and battery; alternatively, the atomization control unit is disposed on the battery at one side away from the atomization base.

12. The electronic cigarette as recited in claim 11, wherein the atomization control unit includes an atomization control circuit and an atomization control switch associated with the atomization control circuit; the atomization control switch is a capacitive sensor switch or gas flow sensor switch or button switch; the atomization control circuit is integrated into the atomization control switch; alternatively, the atomization control unit also includes an atomization control circuit board connected to both of the battery and atomization control switch; and the atomization control circuit is integrated into the atomization control circuit board.

13. An electronic cigarette device comprising an electronic cigar case and an electronic cigarette contained in the cigar case, wherein the electronic cigarette is the one as recited in claim 1.

14. The electronic cigarette as recited in claim 5, wherein one end of the second stem body connected to the first stem body is provided with a second electrode component which connects to the battery; the second electrode component includes a third electrode member and a fourth electrode member; the third electrode member and the forth electrode member are insulated from each other by an insulation sleeve.

15. The electronic cigarette as recited in claim 14, wherein the second insertion member forms the third electrode component; a third guiding hole is defined through a middle portion of the second insertion member and axially extends through the second insertion member; the fourth electrode member is arranged corresponding to the second insertion member, and is secured in the middle portion of the second insertion member by the insulation sleeve; the fourth electrode member is of a hollow tubular construction.

* * * * *